United States Patent [19]

Sarda

[11] 4,378,736

[45] Apr. 5, 1983

[54] INKING DEVICE

[76] Inventor: Jean L. Sarda, 25, rue Pradier, Paris, France, 75019

[21] Appl. No.: 253,392

[22] Filed: Apr. 13, 1981

Related U.S. Application Data

[63] Continuation of Ser. No. 27,829, Apr. 6, 1979, abandoned.

[30] Foreign Application Priority Data

Apr. 7, 1978 [FR] France ..... 78 10437

[51] Int. Cl.[3] ..... B41F 31/04; B41F 31/34

[52] U.S. Cl. ..... 101/365

[58] Field of Search ..... 101/365, 350, 363, 344, 101/364, 207, 208, 210, 148, 351, 356, 360; 165/89, 90

[56] References Cited

U.S. PATENT DOCUMENTS

| | | | |
|---|---|---|---|
| 358,473 | 3/1887 | Neubling | 101/210 |
| 729,002 | 5/1903 | Spalckhaver | 101/210 |
| 1,643,145 | 9/1927 | Winkler | 165/90 X |
| 1,699,389 | 1/1929 | Betzinger | 101/210 |
| 2,359,770 | 10/1944 | Lundbye | 101/157 |
| 2,525,363 | 10/1950 | Luehrs | 101/210 X |
| 2,891,474 | 6/1959 | Smejda | 101/365 |
| 3,014,833 | 12/1961 | Lee | 101/157 |
| 3,285,169 | 11/1966 | Hartwig | 101/364 X |
| 3,635,161 | 1/1972 | Leanna | 101/208 |
| 3,831,517 | 8/1974 | Wagner | 101/208 |
| 3,913,479 | 10/1975 | Cappel et al. | 101/365 |
| 3,921,525 | 11/1975 | D'Amato et al. | 101/365 |
| 3,956,986 | 5/1976 | Wirz et al. | 101/350 |

FOREIGN PATENT DOCUMENTS

| | | |
|---|---|---|
| 1275206 | 9/1961 | France . |
| 1341700 | 9/1963 | France . |
| 2194576 | 3/1974 | France . |

*Primary Examiner*—J. Reed Fisher

*Attorney, Agent, or Firm*—Wigman & Cohen

[57] ABSTRACT

This invention relates to a mechanism and procedure designed for feeding ink to typographic, offset, flexographic and other presses.

This invention is characterized in that the inking mechanism comprises a very high precision rotary drum which homogenizes and supplies, while micrometrically proportioning, one or several films of inks of different colors or kinds.

This procedure is distinguished by the fact that the film or films created is/are directly ready for printing and particularly well suited for the simultaneous handling of different colors or kinds of ink.

9 Claims, 4 Drawing Figures

INKING DEVICE

This application is a continuation of Ser. No. 27,829, filed Apr. 6, 1979 now abandoned.

BACKGROUND OF THE INVENTION

1. Field of the Invention

This invention relates to an inking procedure and mechanism designed for typographic, offset, flexographic, lithographic and other printing presses.

2. Description of the Prior Art

The inking mechanisms used to equip nearly all printing presses are analogous to one another and make possible only the use of one ink per printing.

They are constructed and operate as follows:

A duct serves as reservoir and ink source, and flow is obtained from it through the interplay between the deformation in a flexible steel blade and a metal cylinder, called the ink drum, against which the blade presses. The ink comes into play between the blade and the ink drum and forms as its surface a film of varying thickness depending on the pressure applied to the back of the blade by control screws.

A set of flexible rollers, alternated with metal cylinders, transfers and modifies the ink film to make it ready for inking. Depending on the manufacturer and on the density and quality of inking desired, the number, diameter and arrangement of the rollers and cylinders may vary significantly.

According to this principle of inking, it is possible only approximately to control the thickness of the ink film in zones about 20 mm to 40 mm in width. The advance of the ink drum is generally variable and adjustable.

The film emerging from the duct is relatively thick and not suited to high quality printing; it is improved by each distribution roller which thinly spreads, laminates, mixes and homogenizes it. The distributing cylinders take part in and complete this action; they are called "distributors" because of their axial and rotary movement. Area by area, they even out the thickness of the film and prevent annular ridges which might result from ink surface tension.

The film inking the printing portions of presses must be perfectly even and of constant thickness in a given zone. The acceptable tolerance is of the order of 2 to 3 microns above or below the target thickness.

Depending on the holder, the type of printing and various other factors, the ink forming the film must have a particular rheology, which is determined by its ingredients, possible additives, and the mechanical action of the inking device. To a large degree, the quality of the inking determines the quality of the ultimate print.

Conventional inking mechanisms in general make it possible to meet such requirements. In addition to their bulk and clumsiness, however, they present a number of drawbacks:

imprecise control of ink film thickness in narrow zones, making the juxtaposition of flat tint printing with small characters quite tricky;

unnecessarily excessive ink consumption when the surface area to be printed is negligible in comparison with the overall printing surface of the machine. This consumption becomes very high when there are a number of short printing runs to be made in succession using different colors;

when printing is first started up, the ink balance is obtained only after a certain number of copies have been printed, resulting in paper waste.

Moreover, the basic principle of this type of inking makes it unsuitable for handling different colors of ink in a single printing. Indeed, the so-called distributor cylinders, those which move axially and in rotation, rapidly mix the inks together, and the duct does not allow for the release and control of narrow flows of inks of different colors.

In an effort to overcome this limitation, several patents have been filed. They all retain the same printing principle and, by means of more or less different methods, suggest the creation of zones of discontinuity at the junctions between the different-colored inks by using circumferential grooves in the axially-moving rollers or the rollers working in tandem, or by scraping up the residual ink which remains after the mixing action of the axially-moving rollers. These methods are but palliatives, and are ill adapted to successive runs which may differ greatly from one to the next and often are quite short in numerical terms. Quite apart from discussion of the duct, the sole fact of having to make special "distributor rollers" for each different press run gives rise to additional work for the printer, work which in the vast majority of cases is not justified by the time savings achieved and, in practice, eliminates the advantages of this method.

Indeed, a printer who desires a multicolored printing is required to treat each color in succession, one after another, which does not require as many passes through the press as it does colors except in three- or four-colored prints using plates where the overlaying of the three primary colors theoretically makes it possible to achieve any tint. However, this type of printing is reserved for specific types of prints and still requires 3 or 4 press runs.

This de facto situation makes it difficult to produce multicolor prints at a low cost.

French Pat. Nos. 1.275.206, 1.341.700, and 2.194.576 have proposed solutions aimed at simplifying conventional inking devices by eliminating almost all elements of the sequence of distribution rollers and cylinders.

The basic idea in these patents is to create a single, laminated and proportional ink film by pressing together two cylinders, one of them metal and the other covered by a flexible material, so as to ink the offset plate directly. This procedure allows neither for zone-by-zone control of the film thickness nor for the possibility of partitioning off inks of different colors. This system is perhaps sufficient for use in offset work to handle one color or kind of ink per printing, where in theory each point on the plate takes the same quantity of ink, since nearly all offset presses in use are equipped with inking devices with zone-by-zone control screws similar to those used in typography.

In typographic printing, especially in the case of the platen press where pressure control is rather delicate depending on the lubrication of the printing parts and is closely correlated with the inking, it is essential to control the thickness of the ink film zone by zone.

Depending on their kind or color, inks have different densities and rheologies, which require different thicknesses in order to obtain a given inking.

To devise an offset or typographic inking mechanism able to handle several inks at once, where each film must be inked individually, it is necessary to take the above factor into account and provide the capacity for adjustment in narrow zones, this so as to make it possible for the printer to use narrow "ribbons" of ink.

SUMMARY OF THE INVENTION

This invention relates to an inking mechanism used to create one or several ink films, suited for the inking of the printing parts directly, on a metal cylinder serving as an ink bed. The thickness of the film(s) in question may be controlled micrometrically, one narrow zone at a time.

This device makes it possible to eliminate the series of "distribution" rollers and, within the high precision rotary duct, to introduce different colors or kinds of ink directly in different compartments. This cylinder is preferably cylindrical and inks the inking rollers, which in turn then ink the printing parts.

Another form of the invention makes it possible to eliminate the inking rollers and directly ink the printing parts with the help of a special metal cylinder which acts as a heat radiator and is covered by a hard elastomer whose flexibility is virtually uninvolved in the lamination of the ink. In this arrangement, separators may be made of self-lubricating flexible materials, such as teflon, and the elastomer coating on the metal cylinder may be protected by a varnish so as to protect it at the places where the ink separators are operating.

The metal inking bed may be retained in the device and incorporate a cylinder coated with an elastomer for transferring the ink film to the printing plate, with the rolling by of this cylinder corresponding strictly to that of the printing plate holder so that the inking recurs at the exact same locations with each rotation of the cylinder.

BRIEF DESCRIPTION OF THE DRAWINGS

The description which follows makes reference to the accompanying drawings illustrated as FIGS. 1–4 and is provided by way of example; it relates to one of the numerous applications of the invention and concerns the attachment of an inking device for one or several colors, which may be incorporated on a platen press. This type of inking mechanism, described below, is based on extreme mechanical pressure and requires machining tolerances of the order of 2 to 3 microns greater or lesser than the target for the working parts where the ink film is created and proportioned.

The choice and fineness of the steels used also plays an important role in this configuration.

DETAILED DESCRIPTION OF THE PREFERRED EMBODIMENTS

Figure 1:
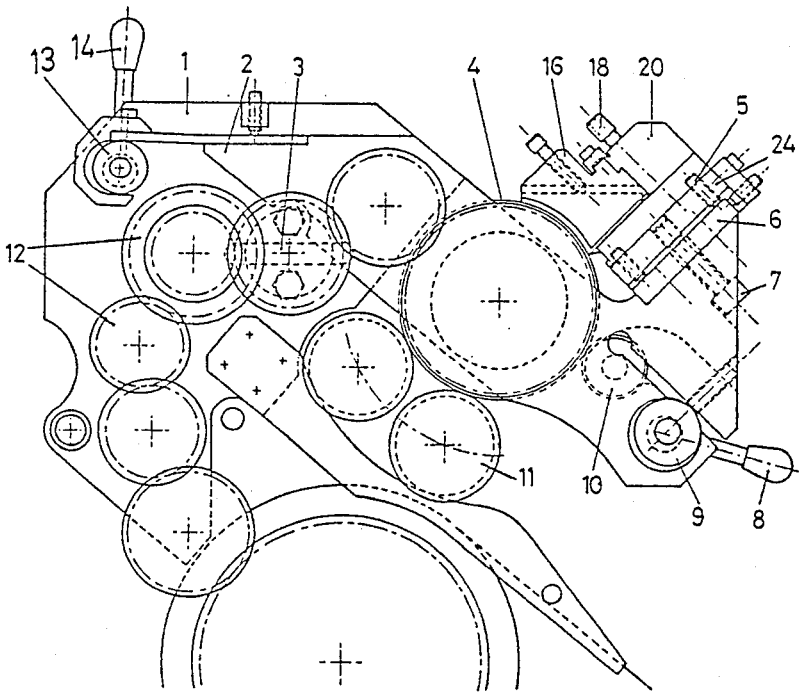
FIG. 1 shows a partial side view of the inking mechanism of the present invention.

The frame of the inking mechanism is made up of two side plates 1, rigidly interconnected by a keyed cross-member 3. The frame supports two movable side plates 2 which pivot when actuated by two eccentrics 13 controlled by a cross shaft which also supports a control lever 14. The function of the control lever 14 is to stop the inking of the inking rollers 11 by removing the ink drum 4 from contact with rollers 11. The ink drum 4 between the side plates 2 receives the ink film. It has a single axle supported by two twin-race ball bearings 28 whose taking-up of slack is automatic. The interior of the drum features fins 30, shown in FIG. 2, for use in dissipating the calories produced by the surface heating attributable to the lamination of the inks and to the friction of the separators 16 which keep the inks apart from multicolor printing. A sleeve 29, plated with a few tenths of a millimeter of finely polished chromium to increase the adhesion of the ink and its spreading, is used to cover the fins 30. Before polishing, this sleeve 29 is carefully trued up. The movement of the gear train 12, shown in FIG. 1, is induced by that of the platen, and causes movement of the drum 4. The rollers 11 are inked directly from the drum 4, where the ink film is re-established with every rotation.

Figure 4:
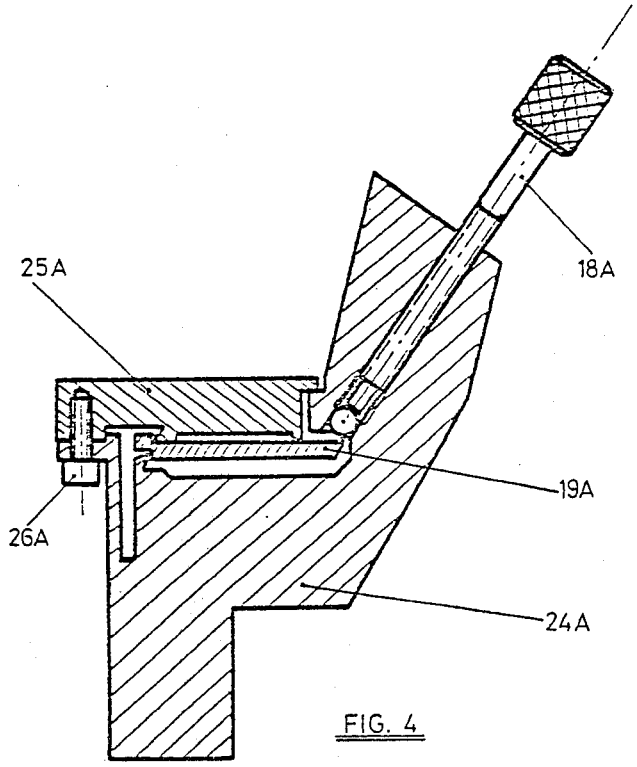
FIG. 4 shows a close-up detailed side view of a second embodiment of the frame for adjusting the plurality of ink controlling or doctoring blades shown in FIGS. 2 and 3.

A holder frame 24A, shown turned upwardly on its back side in the second embodiment in FIG. 4, is provided for the assembly of blades 25A which control or doctor the ink, and their set screw 26A is attached with the help of two abutments made of hardened and ground steel. This frame is removable for cleaning purposes.

Figure 2:
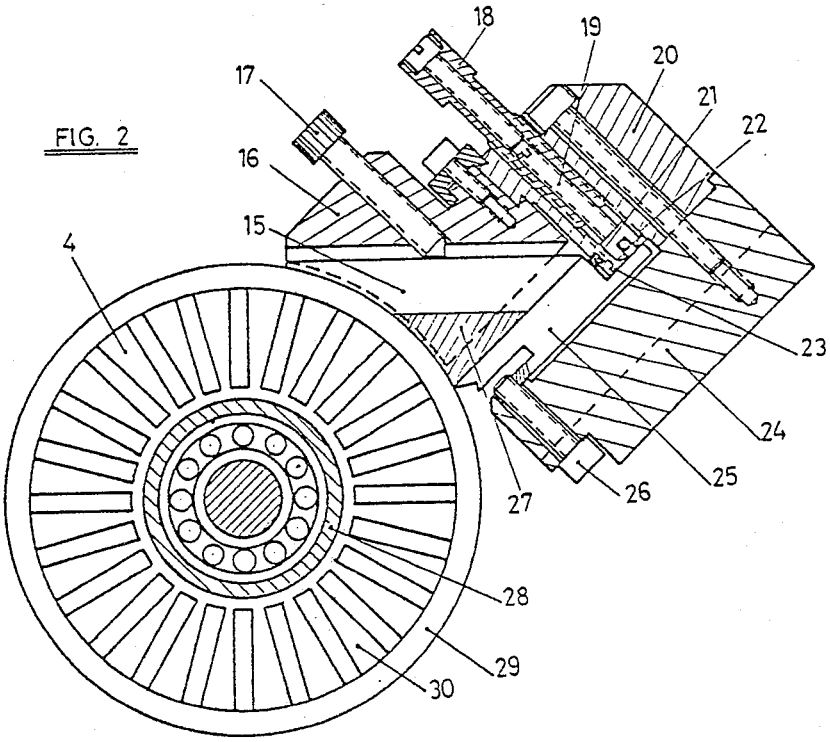
FIG. 2 shows a close-up detailed side view of the ink drum and the frame for carrying the plurality of ink separators shown in FIG. 1.
Figure 3:
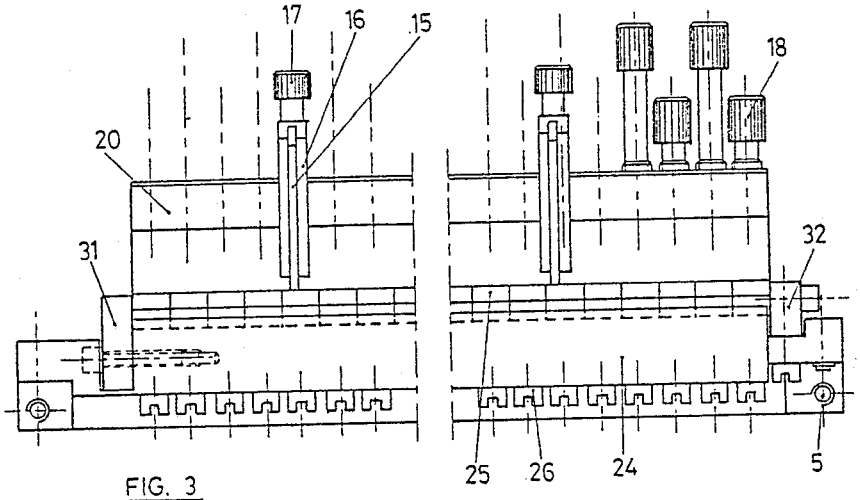
FIG. 3 shows a close-up detailed bottom view of the frame for carrying the plurality of ink separators shown in FIG. 2.

An adjustment screw and counterscrew frame 20, shown in FIGS. 1–3, is firmly secured by screws to the holder frame 24 in the first embodiment. Screw 18A in the second embodiment in FIG. 4 acts on the stepdown lever 19A which moves the blade 25A and makes it possible to adjust it. Each blade 25A is adjustable individually in the first embodiment in FIGS. 1–3. The holder frame 24 and screw frame 20, shown in FIGS. 1–3, are machined from a hardened and ground steel with high mechanical strength.

Each blade 25, shown in FIGS. 2 and 3, is made of a highly processed steel, such as spring steel, which is both hard and elastic. The thirty-five blades 25 shown in FIG. 3 making up the device are hardened and ground true on all their surfaces.

Another piece 31 shown in FIG. 3 of treated steel serves as the squaring reference for the blades 25. Piece 31 is firmly attached to the holder frame 24 and ground true in place for squaring purposes.

The operation of mounting the blades 25 on their holder frame 24 calls for the greatest care. Before mounting, the assembly of the elements is dipped in a solvent and dried with compressed air.

The first blade 25 is placed on the squaring reference piece 31, shown in FIG. 3, and is attached by means of a dynanometric key; the next blade 25 is placed adjacent to the first blade 25 before attachment and so on, until the last blade 25, itself retained by a locking piece 32, shown in FIG. 3, holds the entire blade assembly at its full length and prevents any deformation. A general sealing joint 21, shown in FIG. 2, is put in place to protect the mechanical adjustment assembly from impurities. The blades 25 are contiguous and can move with respect to one another without changing their relative settings. They are impermeable to ink and remain in the set position against the stop 23, shown in FIG. 2, which keeps all the blades 25 at the same setting. These individual blades 25 taken together constitute a single blade 25 which is trued up and finely ground on its working edge against the ink drum 4 with which it cooperates.

The ink carried by the drum 4 is laminated and homogenized and forms a film suitable for printing, which is taken in a conventional manner from the ink reservoir 27, shown in FIG. 2, contained between the drum 4 and the blades 25. Control of the thickness of the ink is variable in one micron increments, with one turn of the screw 18 or 18A corresponding to about 10 microns.

An eccentric 9 and its control lever 8, both shown in FIG. 1, regulate inking in general, by acting through the elastic deformation of the two movable plates 2 which support the drum 4 to provide a course adjustment thereof.

A set of positioning screws 5, shown in FIGS. 1 and 3, makes it possible to place the reservoir 27 precisely with respect to the ink drum 4.

The blade assembly 25 is set at its given position at a distance of about 5 microns from the drum 4, which the assembly must not contact so as to avoid uneven wear on the blades 25 and heating harmful to the device.

A movable separator 16 and the support screw 17 thereof, both shown in FIGS. 1–3 ensure that the different inks are kept apart. A pressure roller 10, made of rubber with a hardness of about 70 Shore units, evens out the ink film in the event that it contains any impurities.

The separators 16 are made either of rigid or semi-rigid material such as polyurethane, high molecular weight polyethylene, etc., lubricated during printing by a wick or other known process in order to limit heating and wear, or are made of a microporous material which, before use, is impregnated with wax or with a lubricating fluid, perhaps ink repellent, such as silicone. Water is also a good ink repellent.

The following is an example of a separator 16 which causes very little heating.

A cardboard felt, weighing about 500 g per square meter when 1 mm thick, is impregnated with a solution containing about 15 percent of dry extract of blocked polyurethane or epoxy resin, in order to fix the fibers, and is then re-impregnated with wax having a melting point of about 90° C. After cooling, the cardboard felt for the separator 16 is cut and finished by machining. Next, the parts of the separator 16 in contact with the blade 25 and the drum 4 are coated by immersion in a hardenable mastic which will counteract the pressure of the laminated ink and ensure complete sealing.

This mastic is based on wax and plastic resin.

Another form of the invention relates to a simplified manufacture of the inking mechanism and, for the most part, is well suited to the construction of semiprofessional offset machines.

In this version, regulation of the ink flow in narrow zones is eliminated and the inking blade assembly 25, shown in FIGS. 1–3, is replaced by a single, rigid blade 25A, which is trued up precisely and general adjustment of which is obtained in the same manner as that described for the contiguous blades 25.

When this procedure is followed and inks of different colors or kinds are being handled simultaneously, it is essential to be able to modify the pigment density of the inks depending on the color density of the tint to be obtained.

In effect, in one and the same tint, the color density is variable in direct correlation with the pigment density of the ink.

By way of example, one simple method which makes it possible to vary the pigment density of the ink at will is described below.

All the inks used will have a high pigment concentration and may be diluted with a conventional transparent additive depending on the color density to be obtained. The basic adjustment of the inking will be carried out on the most dense tint and the other tints will be modulated from that starting point. The reverse process of making the inks more dense may also be done by adding pigment of the same kind to those inks which require such additional thickness. A densitrometer makes it possible to make these adjustments easily and precisely.

Various kinds of mechanisms are used to supply water to offset presses.

Some devices are used mainly for semiprofessional machines and directly mix water with the ink. Most professional machines, however, have one or more wetting rollers (not shown) which supply water to the plate (not shown) as required. Some of these rollers are driven in rotation and in oscillation.

In most cases, and depending on the nature of each ink, it is very difficult to prevent the water from migrating slightly into the ink. Thus, if the simultaneous processing of different colors or kinds of inks is desired, it is essential to eliminate movement in oscillation by the wetting rollers, so as to keep the water, already mixed with one color of ink, from being brought into contact with ink of a different color.

Numerous particularly interesting applications of this procedure are possible, and may be obtained by incorporating, in existing typographic or offset presses, inking devices which are less bulky, more precise and practical to use than those originally provided, and also make it possible to work simultaneously with several inks of different colors or kinds.

Apart from the wide range of possibilities open to this procedure in all traditional press arrangements, there is a vast field for this invention in the printing of labels, paper, wrapping material, etc.

The ability to ink, in given zones depending on the item printed, without having to ink the entire machine, makes it possible to save quite substantial amounts of ink, especially when a succession of short press runs in different colors is involved and when the surface to be printed is small in comparison with the full printing surface of the machine.

The foregoing preferred embodiments are considered as illustrative only. Numerous other modifications and changes will readily occur to those skilled in the art of printing and, consequently, the disclosed invention is not limited to the exact constructions and operations shown and described hereinabove.

I claim:

1. A mechanism for inking the printing parts of a press, comprising:

at least one roller means for simultaneously distributing a plurality of inks to the printing parts of the press;

a single, rotating, non-grooved cylindrical means for carrying the plurality of inks in narrow zones from near the top side of the outer surface of the cylindrical means to said at least one roller means located near the bottom side of the outer surface of the cylindrical means;

at least one blade means, positioned near the top side of the cylindrical means, for micrometrically proportioning the thickness of each of the plurality of inks being carried on the outer surface of said cylindrical means;

a plurality of lever means, maintained in contact with the inner face of the at least one blade means, for independently adjusting the bottom edge of the at least one blade means from the outer surface of the cylindrical means;

a plurality of screw means, positioned above the at least one blade means, for independently actuating each of the plurality of lever means;

a plurality of separator means for dividing the plurality of inks into the narrow zones on the outer surface of the cylindrical means; and a plurality of holder means, positioned near the top side of the cylindrical means, for maintaining the plurality of separator means in simultaneous contact along one edge against the outer surface of the cylindrical means and along another edge against the outer face of the at least one blade means;

wherein said cylindrical means includes a plurality of internal vane means for radiating heat away from the outer surface thereof;

wherein said cylindrical means includes a collar means for forming the outer surface thereof; and wherein said outer surface of the cylindrical means is coated with a hardened elastomer.

2. The mechanism, according to claim 1, wherein each of the plurality of blade means has a thickness of about 5 to 10 millimeters.

3. The mechanism, according to claim 1, wherein said plurality of separator means is made of a microporous material impregnated with an ink-repellent.

4. The mechanism, according to claim 3, wherein said ink-repellent is a wax.

5. The mechanism, according to claim 1, wherein said plurality of separator means is made of a microporous material impregnated with a lubricant.

6. The mechanism, according to claim 1, wherein said plurality of separator means is made of a rigid material.

7. The mechanism, according to claim 1, wherein said plurality of separator means is made of a semi-rigid material.

8. The mechanism, according to claim 7, wherein said semi-rigid material is polyurethane.

9. The mechanism, according to claim 1, wherein each of the plurality of separator means has a thickness of less than one millimeter.

* * * * *